United States Patent [19]

Barber et al.

[11] 4,145,907

[45] Mar. 27, 1979

[54] METAL EDGE TURNING POWER TOOL

[76] Inventors: Howard J. Barber, 29 SE. 37th St., Oklahoma City, Okla. 73129; William J. Daniel, Rte. #4, 413 Oliphanit Ave., Normon, Okla. 73069; W. P. McNutt, 600 N. Baer Dr., Moore, Okla. 73160

[21] Appl. No.: 828,216

[22] Filed: Aug. 26, 1977

[51] Int. Cl.[2] ..... B21D 11/04

[52] U.S. Cl. ..... 72/318; 72/176; 113/54 R

[58] Field of Search ..... 72/318, 447, 176; 113/54 R, 57

[56] References Cited

U.S. PATENT DOCUMENTS

| | | | |
|---|---|---|---|
| 2,646,100 | 7/1953 | Gibson | 113/54 X |
| 2,877,820 | 3/1959 | Ristow | 113/54 X |
| 3,188,729 | 6/1965 | Pogue et al. | 113/54 UX |

*Primary Examiner*—Leon Gilden

*Attorney, Agent, or Firm*—Berman, Aisenberg & Platt

[57] ABSTRACT

An automatic edge turner for sheet metal that includes a pair of perpendicularly oriented bending blades. One of the blades is vertically oriented and is adapted to be reciprocated by a power tool such as a unit shear. The other blade is horizontally disposed and is fixedly positioned adjacent and below the reciprocating blade. The stationary blade is maintained in position by a holding unit which extends rearwardly and arcuately about the housing for the reciprocating blade. The stationary blade is adapted to ride underneath the edge of sheet metal to be bent, and the two blades have cooperating right angled surfaces for bending the edge of sheet metal as it passes therebetween.

6 Claims, 10 Drawing Figures

FIG. 1.
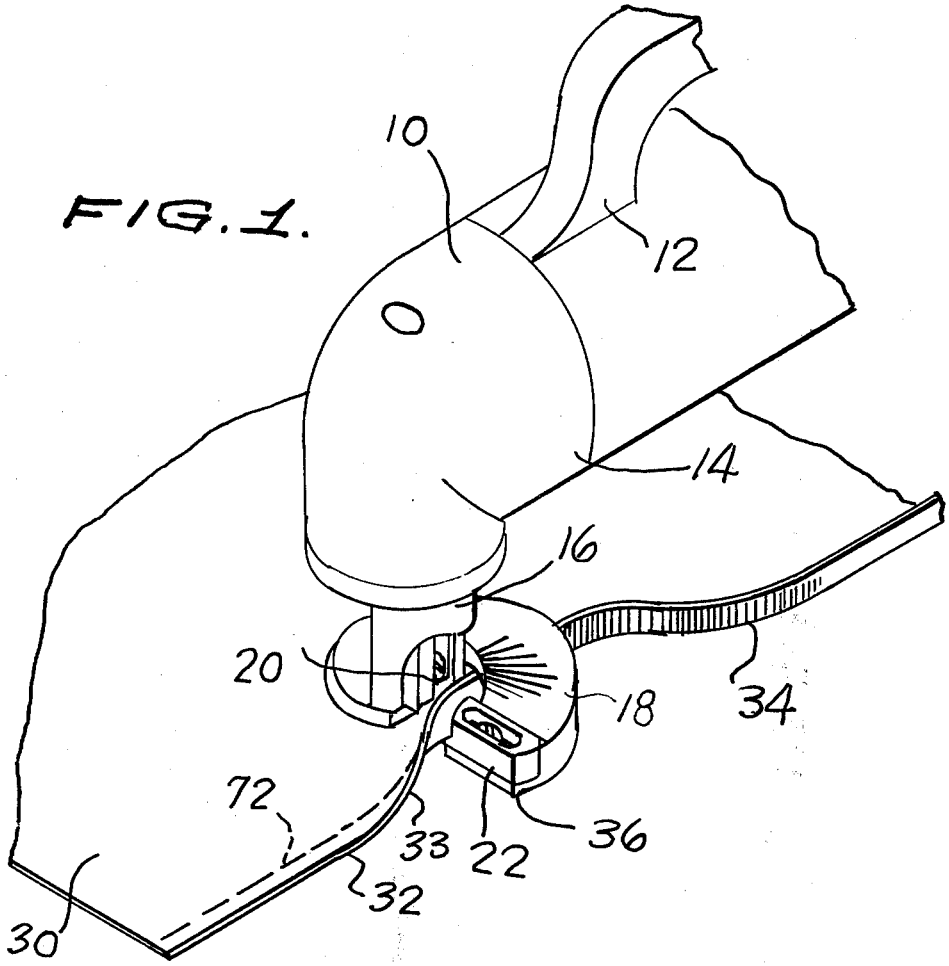
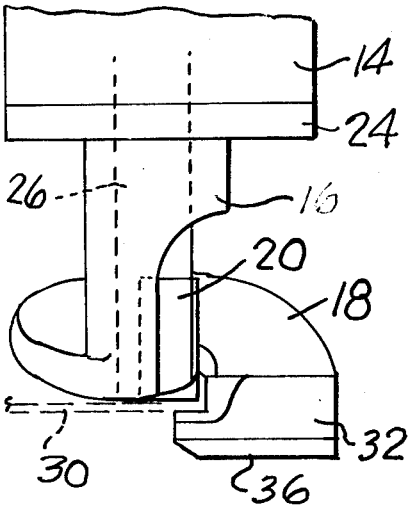
FIG. 2.
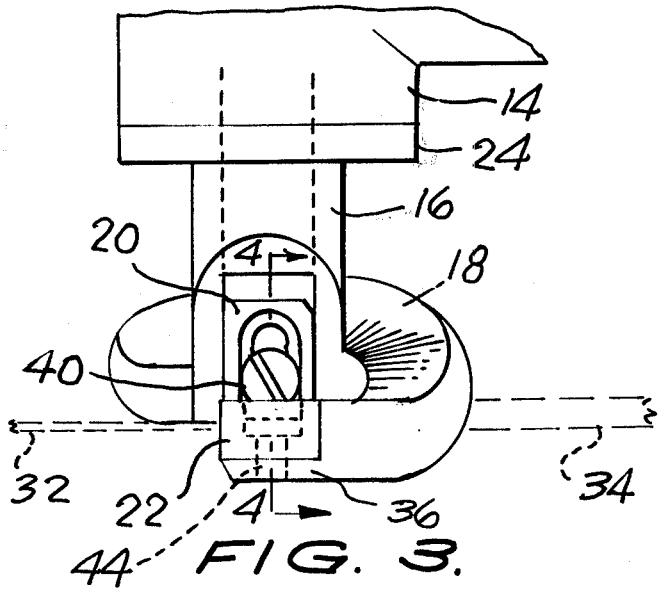
FIG. 3.

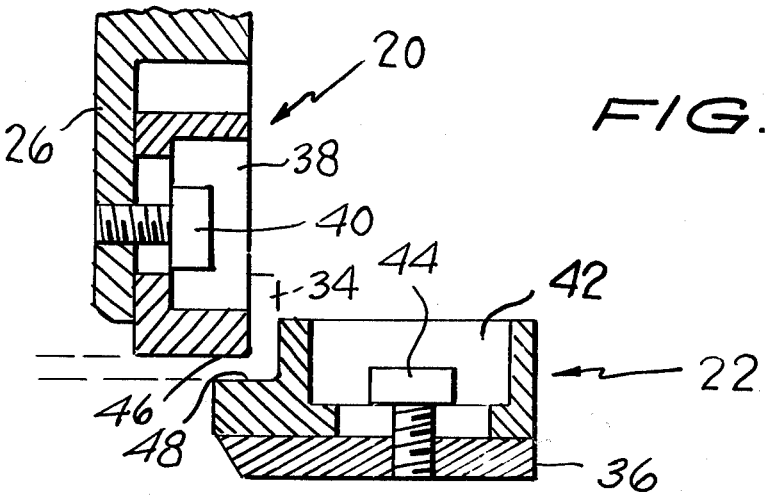
FIG. 4.
FIG. 5.
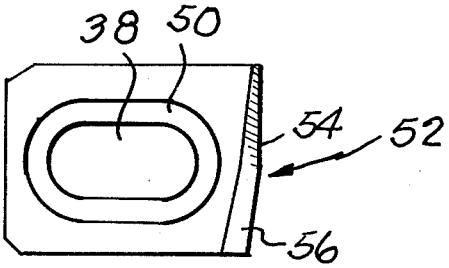
FIG. 8.
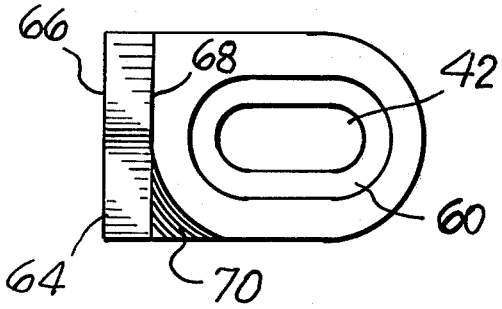
FIG. 6.
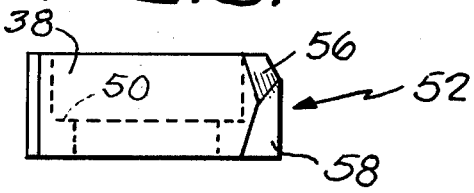
FIG. 9.
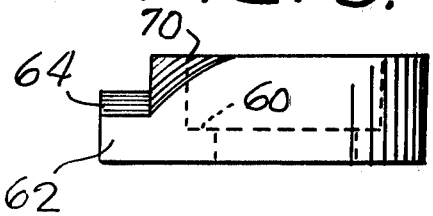
FIG. 7.
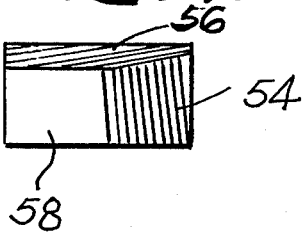
FIG. 10.
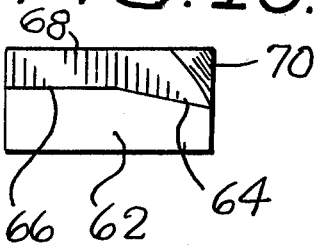

METAL EDGE TURNING POWER TOOL

BACKGROUND OF THE INVENTION

1. Field of the Invention

The present invention is directed towards apparatus for bending sheet metal and, more particularly, is directed towards a power tool which is particularly adapted to bend the edge of sheet metal preparatory to forming a duct work joint.

2. Description of the Prior Art

A multitude of techniques and machines have been proposed and are known for bending sheet metal. In particular, the prior art suggests many devices and machines for bending sheet metal edges preparatory to the formation of what is known in the art as a Pittsburgh lock that is utilized extensively in the formation of air conditioning duct work and the like.

Prior art United States patents in this general art area of which we are aware include: U.S. Pat. Nos. 2,609,028; 2,660,909; 2,877,820; 3,188,729; 3,421,356; 3,477,272; 3,680,346; 3,015,293; 3,636,903; and 3,987,740.

By way of example, U.S. Pat. No. 3,680,346 illustrates a hand tool for rolling over and crimping the edge of an aluminum foil cover about the edge of a container, while U.S. Pat. No. 2,660,909 illustrates a pivoted sheet metal flanging hand tool.

U.S. Pat. No. 3,421,356 teaches a tool for crimping an upstanding flange on one panel about the edge of another overlying panel, while U.S. Pat. No. 3,477,272 shows a similar type device.

However, each of the prior art devices suffer from one or more deficiencies. More particularly, we have found that the prior art devices are extremely difficult to utilize when it is necessary to bend the edge of a curved piece of sheet metal. Most of the prior art machines are bulky, expensive and relatively complex, and are not adapted to be portable nor easily used. Their general bulkiness and complexity do not lend themselves to ease of use with curved edges of sheet metal which are frequently encountered and are necessary to be utilized in many air conditioning duct work installations.

It would therefore be extremely advantageous if apparatus were provided which is inexpensive, easy to utilize with existing power tools, and which permits rapid and easy bending of sheet metal edges, especially curved sheet metal edges.

OBJECTS AND SUMMARY OF THE INVENTION

It is therefore a primary object of the present invention to provide a new and improved metal edge turning power tool which overcomes all of the deficiencies noted above with respect to prior art devices.

Another object of the present invention is to provide a metal edge turning power tool which is particularly designed to enable the bending of curved edges of sheet metal in a simple, straightforward and easily manipulatable manner.

Further objects of the present invention include the provision of a metal edge turning power tool which is economical to fabricate, may be readily adapted to be installed and work with existing power tools, and which facilitates the bending of sheet metal edges and therefore substantially reduces labor costs inherent in such processes.

The foregoing and other objects are attained in accordance with one aspect of the present invention through the provision of apparatus for bending the edge of sheet metal, which comprises a first horizontally disposed blade member, a second vertically disposed blade member, means for vertically reciprocating the second blade member, a housing for containing the reciprocating means, and means for holding the first blade member in a fixed position relative to the housing, whereby the edge of sheet metal may be bent as it passes between the first and second blade members. The holding means more particularly comprises an arcuate blade support member which extends from the housing behind the second blade member for maintaining the position of the first blade member below the lowest position of the second blade member such that, in use, the first blade member is positioned underneath the edge of the sheet metal being bent.

In accordance with other aspects of the present invention, the first blade member includes a generaly L-shaped surface having a lower ledge which is substantially horizontally disposed and whose forward end is tapered downwardly. The L-shaped surface of the first blade member further includes a side substantially vertical ledge adjacent to the lower ledge and having a forward end which is curved outwardly from the lower ledge. The second blade member preferably includes a bending surface formed at the lower edge thereof and which includes a forwardly disposed outwardly extending portion, a rearwardly disposed vertical portion, and a tapered portion formed above the forwardly and rearwardly disposed portions.

In accordance with still other aspects of the present invention, both the first and second blade members include an elongated slot formed centrally therethrough, and means positionable within the slot for securing the first blade member to the means for holding same and the second blade member to the reciprocating means, respectively.

The first and second blade members are disposed perpendicularly with respect to one another and have opposed right-angled surfaces between which the edge of sheet metal is adapted to be bent.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a perspective view illustrating a preferred embodiment of the present invention during use;

FIG. 2 is an enlarged, partial front view of the apparatus illustrated in FIG. 1;

FIG. 3 is a side view of the preferred embodiment of the present invention illustrated in FIG. 1;

FIG. 4 is an enlarged, sectional view illustrating the relative position of the two blade members which form the preferred embodiment of the present invention and taken along line 4—4 of FIG. 3;

FIG. 5 is a top view of one of the blade elements of the present invention;

FIG. 6 is a side view of the blade element shown in FIG. 5;

FIG. 7 is an end view of the blade element illustrated in FIG. 6;

FIG. 8 is a top, plan view of the other blade element of the present invention;

FIG. 9 is a side view in elevation of the blade element illustrated in FIG. 8; and FIG. 10 is an end view of the blade element illustrated in FIG. 9.

DETAILED DESCRIPTION OF THE PREFERRED EMBODIMENT

Referring now to the drawings, wherein like reference numerals represent identical or corresponding parts throughout the several views, and more particularly to FIG. 1 thereof, a preferred embodiment of the present invention is illustrated during use in a perspective view. Reference numeral 10 indicates generally a power tool which may be utilized in conjunction with the present invention and may, for example, be comprised of a power shear machine such as Unit Shear No. 12 manufactured by the Black & Decker Company.

The power shear 10 includes a handle 12, a motor housing 14, and a shank 16 which extends downwardly from the front portion of the motor housing 14. As seen in FIGS. 2 and 3, the shank 16 is mounted to the motor housing 14 via a mounting plate 24.

The shank 16 of the machine 10 is hollow and houses a shaft 26 which is vertically reciprocable within the shank 16, as is conventional in a machine of this nature. Attached to the lower end of the reciprocating shaft 26 so as to move therewith is a blade member 20, the structure and function of which will be described in greater detail hereinafter.

Attached to and extending from the lower end of the shank 16 of machine 10 is a blade support member 18. Blade support member 18 is preferably formed of steel and is arcuately shaped so as to extend around, behind and below the shank 16 in a somewhat helical fashion, as perhaps best may be appreciated from FIGS. 2 and 3. The blade support member 18 terminates at a position substantially adjacent but below the position of the reciprocating blade member 20 and includes a lower mounting lip 36 in such a fashion so as to receive another blade member 22 which is stationarily affixed thereto as by, for example, a mounting bolt 44.

Referring now to FIG. 4, the blade elements 20 and 22 are shown in an enlarged, cross-sectional view. The vertically disposed blade member 20 is seen to include an elongated recess 38 which is adapted to receive a recessed bolt 40 for mounting the blade member 20 to the reciprocating shaft 26 of machine 10. In a similar manner, the horizontally disposed blade member 22 includes an elongated recess 42 formed in the central portion thereof for receiving a recessed mounting bolt 44 which is secured through a corresponding threaded opening in the mounting lip 36 of support member 18.

Referring now to FIGS. 5 through 7, the vertically oriented blade member 20 is illustrated in greater detail and is seen to be comprised of a substantially rectangular piece of metal which is, in a best mode, 13/16 inch long, $\frac{5}{8}$ inch wide, and $\frac{3}{8}$ inch high. Reference numeral 50 indicates a flange formed within recess 38 for securing the head of the mounting bolt 40. Reference numeral 52 indicates generally the lowermost face of the blade member 20 and includes a substantially flat rear portion 54 which is substantially parallel with the sheet metal surface 30 that is being bent. The forward portion of the front face 52 includes an upwardly tapering leading edge 58 next to which is positioned an outwardly tapered top portion 56. The forward edges 56 and 58 cooperate to bend the incoming metal gently, while the rear edge 54 cooperates with a corresponding ledge to be described below to create a 90° angle in the sheet metal.

FIGS. 8 through 10 illustrate the substantially horizontally oriented blade member 22 in greater detail. In a best mode, blade member 22 is approximately 1 and 1/16 inches long, 11/16 inch wide, and $\frac{3}{8}$ inch high. The blade 22 includes a flange 60 which extends about the inner periphery of recess 42 for retaining the head of the bolt 44.

Reference numeral 62 indicates a lower, substantially horizontal ledge whose top face tapers upwardly from an initial slope 64 to a rear, substantially horizontal surface 66.

Adjacent and substantially perpendicular to the lower ledge 62 is a vertical side surface 68 which at its forward end 70 tapers outwardly to form a gradual receiving edge for the metal to be bent.

Referring back to FIG. 1, the operation of the present invention will now be explained. Reference numeral 30 indicates a piece of sheet metal, such as that commonly used for air conditioning duct work. Sheet metal 30 has a curved outer edge 32, and it is necessary to form a right-angle bend 34 which is generally on the order of $\frac{1}{4}$ inch long. The machine 10 has the blade members 20 and 22 mounted thereto as illustrated in FIG. 1 and is placed such that the support member 18 positions blade member 22 adjacent but below the edge 32 desired to be bent. Upon reciprocation of blade member 20 by actuating machine 10, the leading edges 56 and 58 thereof cooperate with the leading edges 64 and 70 of blade member 22 so as to gently but firmly upturn the edge 33 ahead of its insertion between the blade members 20 and 22. The rear faces 54, 66 and 68 of blade members 20 and 22 continue to act on the upturned metal 33 so as to create the desired right angle bend 34 as the blade member 20 continues to reciprocate. As may be appreciated from FIGS. 2 and 4, the rearmost facing surfaces 54, 66 and 68 have opposed right-angled surfaces 46 and 48 between which the edge 34 is finally formed. It is frequently helpful to mark a scribe line 72 approximately $\frac{1}{4}$ inch inwardly of the edge 32 of the sheet metal 30 as a guide for the vertically reciprocating member 20 to follow. It may be appreciated by virtue of the foregoing that the present invention affords a simple, economical and quick way for bending the edge of a piece of sheet metal, and by virtue of its compactness and portability and short working area is easily adapted to bend curved edges of sheet metal with ease.

Obviously, numerous modifications and variations of the present invention are possible in light of the above teachings. It is therefore to be understood that within the scope of the appended claims, the invention may be practiced otherwise than as specifically described herein.

We claim as our invention:

1. Apparatus for bending the edge of sheet metal, which comprises:

a first horizontally disposed blade member;

a second vertically disposed blade member;

means for vertically reciprocating said second blade member;

a housing for containing said reciprocating means; and means for holding said first blade member in a fixed position relative to said housing, whereby said edge of sheet metal may be bent as it passes between said first and second blade members;

wherein said first blade member includes means for turning said edge of sheet metal upwardly which comprises a generally L-shaped surface having a substantially horizontal lower ledge whose forward end is tapered downwardly and a substantially vertical side ledge adjacent to said lower ledge and including a forward end which is curved outwardly from said lower ledge.

2. The sheet metal edge bending apparatus as set forth in claim 1, wherein said holding means comprises an arcuate blade support member which extends from said housing behind said second blade member for maintaining the position of said first blade member below the lowest position of said second blade member whereby said first blade member is positioned in use underneath the edge of sheet metal being bent.

3. The sheet metal edge bending apparatus as set forth in claim 1, wherein said first blade member further includes an elongated slot formed centrally therethrough, and further comprising means positionable within said slot for securing said first blade member to said means for holding same.

4. The sheet metal edge bending apparatus as set forth in claim 1, wherein said first and second blade members are disposed perpendicularly with respect to one another and have opposed right angled surfaces between which said edge of sheet metal is adapted to be bent.

5. Apparatus for bending the edge of sheet metal, which comprises:

a first horizontally disposed blade member;

a second vertically disposed blade member;

means for vertically reciprocating said second blade member;

a housing for containing said reciprocating means; and means for holding said first blade member in a fixed position relative to said housing, whereby said edge of sheet metal may be bent as it passes between said first and second blade members;

wherein said second blade member includes a bending surface formed at the lower edge thereof and which includes a forwardly disposed outwardly extending portion, a rearwardly disposed vertical portion, and a tapered portion formed above said forwardly and rearwardly disposed portions.

6. The sheet metal edge bending apparatus as set forth in claim 5, wherein said second blade member further includes an elongated slot formed centrally therethrough, and further comprising means positionable within said slot for securing said second blade member to said reciprocating means.

* * * * *